US007107629B2

(12) United States Patent
Miros et al.

(10) Patent No.: US 7,107,629 B2
(45) Date of Patent: Sep. 19, 2006

(54) APPAREL INCLUDING A HEAT EXCHANGER

(75) Inventors: Robert H. J. Miros, Seattle, WA (US); Tamara L. Schirrmacher, Alameda, CA (US)

(73) Assignee: Coolsystems, Inc., Berkeley, CA (US)

( * ) Notice: Subject to any disclaimer, the term of this patent is extended or adjusted under 35 U.S.C. 154(b) by 358 days.

(21) Appl. No.: 10/637,719

(22) Filed: Aug. 8, 2003

(65) Prior Publication Data

US 2004/0078864 A1 Apr. 29, 2004

Related U.S. Application Data

(60) Provisional application No. 60/402,313, filed on Aug. 9, 2002.

(51) Int. Cl.
*A61F 7/00* (2006.01)
*A41D 1/02* (2006.01)

(52) U.S. Cl. ..... 2/458; 2/7; 2/84; 62/259.3

(58) Field of Classification Search ..... 2/458, 2/7, 8, 108, 97, 84, 69, 94, 102, 93, 81, 171.2; 62/259.3; 607/104, 108, 112, 107, 109–111; 165/46

See application file for complete search history.

(56) References Cited

U.S. PATENT DOCUMENTS 2,413,386 A * 12/1946 Schulz ..... 128/201.29
2,540,547 A * 2/1951 Rodert ..... 165/47
2,608,690 A * 9/1952 Kolb et al. ..... 2/97
3,738,367 A * 6/1973 Hardy ..... 607/104
4,147,921 A * 4/1979 Walter et al. ..... 219/211
4,194,247 A * 3/1980 Melander ..... 2/457
4,547,906 A * 10/1985 Nishida et al. ..... 2/93
4,718,429 A * 1/1988 Smidt ..... 607/104
4,964,282 A * 10/1990 Wagner ..... 62/259.3
5,086,771 A * 2/1992 Molloy ..... 604/113
5,172,689 A * 12/1992 Wright ..... 607/104
5,243,706 A * 9/1993 Frim et al. ..... 2/455
5,269,369 A * 12/1993 Faghri ..... 607/104
5,314,455 A * 5/1994 Johnson, Jr. et al. ..... 607/104
5,411,541 A * 5/1995 Bell et al. ..... 607/104
5,524,293 A * 6/1996 Kung ..... 2/102
5,533,354 A * 7/1996 Pirkle ..... 62/259.3
5,539,934 A * 7/1996 Ponder ..... 2/413
6,105,382 A * 8/2000 Reason ..... 62/259.3
6,109,338 A * 8/2000 Butzer ..... 165/46
6,178,562 B1 * 1/2001 Elkins ..... 2/458
6,695,872 B1 * 2/2004 Elkins ..... 607/104
6,942,015 B1 * 9/2005 Jenkins ..... 165/46
7,008,445 B1 * 3/2006 Lennox ..... 607/109
2005/0143796 A1 * 6/2005 Augustine et al. ..... 607/104

* cited by examiner

*Primary Examiner*—A. Vanatta

(57) ABSTRACT

One embodiment of the present invention is apparel that includes: (a) a heat exchanger adapted to be worn in close proximity to a portion of a body; (b) a garment adapted to cover the heat exchanger; and (c) a multiplicity of anchors that couple the heat exchanger and the garment at a multiplicity of anchor locations.

16 Claims, 2 Drawing Sheets

APPAREL INCLUDING A HEAT EXCHANGER

This application claims the benefit of U.S. Provisional Application No. 60/402,313, filed on Aug. 9, 2002, which application is incorporated herein by reference.

TECHNICAL FIELD OF THE INVENTION

One or more embodiments of the present invention relate to temperature control apparel for parts of a human or other animate body and, more particularly, to apparel such as, for example and without limitation, hood and torso apparel, that includes a heat exchanger.

BACKGROUND OF THE INVENTION

It is common to apply cold and compression to a traumatized area of a human body to facilitate healing, and to prevent unwanted consequences of the trauma. For example, cold packing with ice bags or the like traditionally are used to provide deep core cooling of a body part. In addition, elastic wraps are often applied to provide compression. However, these traditional techniques are uncontrollable. For example, the temperature of an ice pack will change when the ice melts, and the application of elastic wraps and, consequently the pressure provided thereby, varies considerably—even when the wrappers are experienced. Because of these and other difficulties, many have turned to more complicated arrangements which include cooling units for maintaining a desired temperature through a heat exchanger. Some of these cooling units also provide compressive pressure. Active cooling arrangements for humans are used, or contemplated for use, in physical therapy, pre-game conditioning, minor injury care, and so forth.

Designs exist that enable a heat exchanger to be thin, and enable it not to buckle when it conforms to a complex shape to remain in good thermal contact with a body part. As one can readily appreciate, there are instances where a person using such a heat exchanger may wish to do so while going about his/her daily activities. Further, the person may wish to do this without bringing undo attention to the fact that he/she is using a heat exchanger. This entails being able to provide apparel that covers a body part, and also carries and covers the heat exchanger. For example, such apparel might include a jacket with a hood that enables a heat exchanger that covers a person's torso and/or head to be covered as well.

A problem exists in using prior art techniques to provide a garment to carry the heat exchanger since the heat exchanger would typically be attached about (at least a large portion of) its border to the inside of the garment. Then, when in use, as the heat exchanger is compressed about the body part, the garment would be bunched, and the outline of the heat exchanger would be visible from outside the garment. This provides an awkward, and unnatural appearance. Additionally, the misshaping of the garment may provide some discomfort to the wearer. Lastly, attaching closely to the seams or outlines of the outer garment often results in a heat exchanger which provides poor contact with the torso, limb, or head being treated.

In light of the above, there is a need in the art for apparel solves one or more of the above-identified problems.

SUMMARY OF THE INVENTION

One or more embodiments of the present invention advantageously solve one or more of the above-identified problems. In particular, one embodiment of the present invention is hood and torso apparel that comprises: a heat exchanger adapted to be worn in close proximity to a portion of a body; a garment adapted to cover the heat exchanger; and a multiplicity of anchors that couple the heat exchanger and the garment at a multiplicity of anchor locations.

The invention may also include a garment opening and closing mechanism, such as hook-and-loop fasteners, draw strings, elastic banding, snaps, or zippers, that may be affixed about a portion of a perimeter of the garment.

The invention may also include an adjustment mechanism (such as hook-and-loop fasteners, a draw string, elastic banding, a buckle, a snap, or a zipper) affixed to the garment, which adjustment mechanism and garment opening and closing mechanism are adapted to provide a micro-climate for the portion of the body.

The invention may also include a second heat exchanger adapted to be worn in close proximity to a second portion of the body, and the garment may be further adapted to cover the first and second heat exchangers, with the apparel further including an anchor coupling the garment and the second heat exchanger. Alternatively, the first and second heat exchangers may be coupled to first and second garments, respectively. Heat exchange fluid may circulate through the first and second heat exchangers serially, separately or in parallel.

The invention is described in further detail below with respect to the drawings.

DETAILED DESCRIPTION

Figure 1:
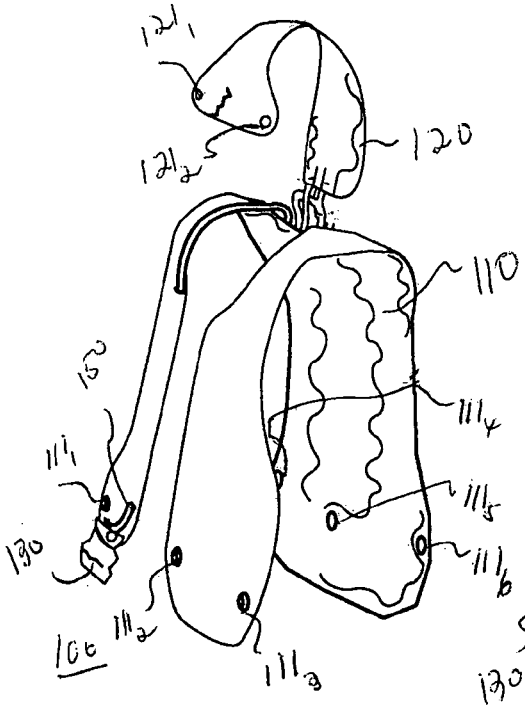
FIG. 1 shows, in pictorial form, a heat exchangers according to one or more embodiments of the present invention.

FIG. 1 shows, in pictorial form, heat exchanger 100 that may be used to fabricate one or more embodiments of the present invention. As shown in FIG. 1, heat exchanger 100 comprises torso unit 110 and head unit 120. The invention can be used with many different heat exchanger designs. For example, in accordance with one or more embodiments of the present invention, torso unit 110 and head unit 120 are each comprised of a first compliant component (a heat exchange component) through which a heat exchange material such as a liquid flows, and a second compliant component (a pressure inducing component) that overlays the first component through which a pressure generating material such as, for example, air or another gas, flows to apply pressure to the respective body part, and to press the heat exchange material close thereto. In addition, in accordance with some of such embodiments, matrices of point (dot) connections and smooth, curvilinear fences (flow directing devices) may be included in the first (heat exchange) component to provide liquid mixing and a liquid flow pattern that enables a substantially constant flow of liquid having a constant temperature through the heat exchange component. Further, the shape of the fences and component edge contours (for example, smooth curvilinear ripples) are selected to inhibit formation of eddies to ensure liquid flow that enables a constant and controlled temperature differential between the heat exchanger and the body part. Further details of heat exchanger designs may be found in U.S. Pat. No. 6,178,562 and in U.S. patent application Ser. No. 09/765,082, the disclosures of which are incorporated herein by reference.

It should be understood that torso unit 110 and head unit 120 may be connected so that the heat exchange material and the gas each flow through the units: (a) in series (for example, and without limitation, where a heat exchange liquid first circulates through head unit 120, and then circulates through torso unit 110); or (b) independently, i.e., either separately or in parallel.

As further shown in FIG. 1, connector 130 connects to a control unit (not shown) that supplies: (a) a heat exchange material, for example, a fluid, at predetermined temperatures and pressures; and (b) a pressure generating material, for example, a gas, at a predetermined temperatures and pressure to torso unit 110 and to head unit 120. It should be understood that for these embodiments, the heat exchange material may be a gas instead of a liquid, and the pressure generating material may be a liquid rather than a gas.

The control unit includes a mechanism for cooling and circulating a liquid coolant. In this connection, the control unit includes not only a circulator for circulating a desired low temperature liquid, but also a heat exchange unit for removing heat from the same. It further includes a mechanism for supplying pressurized air. In accordance with one or more embodiments of the present invention, the control unit may include an internal or external battery pack, and/or an AC adapter for use with either 110 or 220 AC power (an automobile adapter may also be used to obtain power).

In accordance with one such embodiment, the dot matrix is organized into two sets of imaginary lines connecting dots of the dot matrix to nearest dots. The first imaginary lines cross the second lines at an angle falling in a range of between 70 degrees and 110 degrees, crossing at about 90 degrees. Moreover, one of the two sets of lines is disposed at an angle of about 25 to 65 degrees, preferably 45 degrees, with respect to the normal direction of flow of liquid through the heat exchange component.

Although the liquid (and its pressure and temperature), and the gas (and its pressure) may depend upon the design and purpose of the heat exchanger, in accordance with one or more embodiments of the present invention, the head/torso heat exchanger may operate at a relatively constant liquid pressure in a range from about 3 PSI to about 20 PSI, and at a liquid temperature in a range from about 33° F. to about 115° F. In accordance with one such embodiment, the heat exchange liquid is water. Further, in accordance with one or more such embodiments, the pressure of the air is generally in a range from about 0.2 PSI to about 1.75 PSI. In addition, in accordance with one or more such embodiments of the present invention, the air pressure may be cycled between two values.

Figure 2:
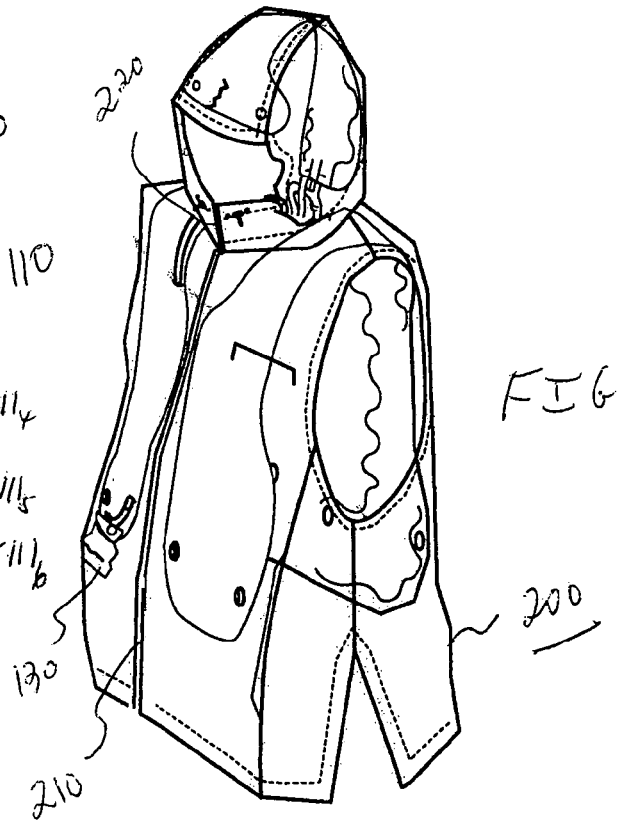
FIG. 2 shows, in pictorial form, a garment that carries the heat exchangers shown in FIG. 1.

Connector 130 shown FIGS. 1 and 2, connects three tubes that are located within, and protected by, sleeve 150. Two of the three tubes connect to the heat exchange component to introduce heat exchange liquid into this component and to receive heat exchange liquid exited from this component, and the third of the three tubes is connected to the pressure inducing component to introduce gas into this component.

As further shown in FIG. 1, torso unit 110 includes anchors in the form of snap mechanisms $\mathbf{111}_1$ to $\mathbf{111}_5$, and head unit 120 includes anchors in the form of snap mechanisms $\mathbf{121}_1$ to $\mathbf{121}_2$. As will be described in detail below, the anchors are utilized to affix torso unit 110 and head unit 120 to an inside (or a liner) of a garment at a number of points.

FIG. 2 shows, in pictorial form, garment 200 that carries torso unit 110 and head unit 120 shown in FIG. 1. As shown in FIG. 2, torso unit 110 and head unit 120 are attached, anchored or affixed to an inside (or a liner) of garment 200 by anchors in the form of snaps that are conjugate to snap mechanisms $\mathbf{111}_1$ to $\mathbf{111}_5$ of torso unit 110, and to snap mechanisms $\mathbf{121}_1$ to $\mathbf{121}_2$ of head unit 120. As one can readily appreciate, although this embodiment is described utilizing snap mechanisms, further embodiments can be fabricated wherein torso unit 110 and head unit 120 are attached, anchored or affixed to the inside (or a liner) of garment 200 utilizing any anchor mechanism for attachment, and preferably a detachable anchor or attachment mechanism such as, for example, and without limitation, hook-and-loop fasteners, side-release buckles, zippers, and so forth. Advantageously, because torso unit 110 and head unit 120 are attached, anchored or affixed to the inside (or a liner) of garment 200 at a relatively few points, when the heat exchange units are operated to conform to their respective body parts, garment 200 will not be bunched or puckered, and it will retain its natural appearance. As a result, the heat exchange units can float within, but remain anchored to, garment 200. The number and location of anchors for use in fabricating one or more embodiments of the present invention that utilize a particular garment and a particular heat exchanger can be determined routinely by one of ordinary skill in the art without undue experimentation.

As shown in FIG. 2, garment 200 includes opening and closing mechanisms 210 (relating specifically to the torso) and 220 (relating specifically to the neck and head) along a center-front thereof. For example, in accordance with one or more embodiments of the present invention, opening and closing mechanisms 210 and 220 may include, for example, and without limitation, hook-and-loop fasteners, a zipper, a button and buttonhole arrangement, snaps, elastic banding, draw strings, and/or a flap that attaches with, for example, snaps or hook-and-loop fasteners. Further, in accordance with one or more such embodiments of the present invention, such opening and closing mechanisms are affixed about a portion of a perimeter of garment 200 (for example, a portion of a perimeter of the hood and a portion of a perimeter of the torso).

Figure 3:
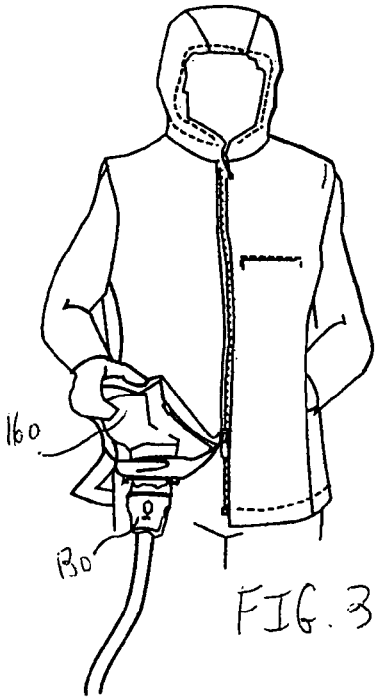
FIG. 3 shows, in pictorial form, a garment having a flap that covers a connector between the heat exchanger and a control unit.

FIG. 3 shows, in pictorial form, one embodiment of garment 200 that includes flap 160 that covers connector 130 to hide it from view when garment 200 is worn.

Figure 4:
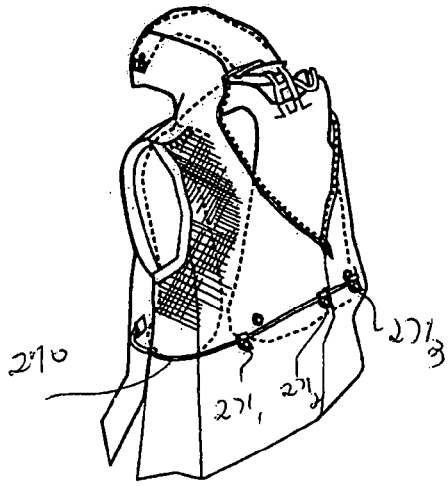
FIG. 4 shows, in pictorial form, a back of the garment shown in FIG. 2 that displays a torso adjustment mechanism.
Figure 5:
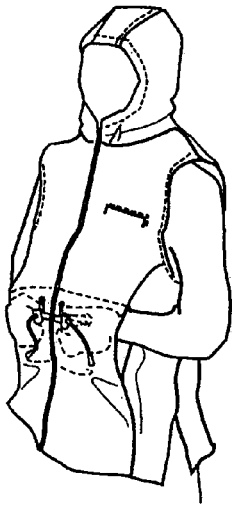
FIGS. 5 and 6 show how adjustment mechanisms can be used for the torso and head, respectively.
Figure 6:
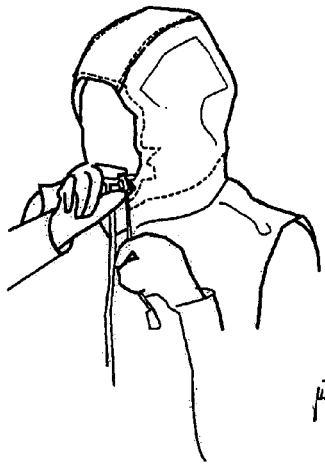

FIG. 4 shows, in pictorial form, a back of garment 200 that displays torso adjustment mechanism 270. As shown in FIG. 4, torso adjustment mechanism 270 is a "draw string" that is threaded through loops 2711 to 2713 that are affixed to the inside (or lining) of garment 200. Torso adjustment mechanism 270 can be fabricated from any one of a number of materials that are well known to those of ordinary skill in the art such as, for example and without limitation, string materials (fabricated from natural or synthetic fibers), woven cloth, leather, and so forth. In accordance with one such embodiment, string 270 extends from two holes disposed near the waist of garment 200. Then, when string 270 is draw and tied (refer to FIG. 5), torso unit 110 is brought close to the wearer's torso. Then, when air is pumped into the pressure generating component, it fits snugly about the torso. A similar arrangement of a hood adjustment mechanism can be used so that a "draw string" can be drawn and tied about the head (refer to FIG. 6) to bring head unit 120 close to the wearer's head. The hood adjustment mechanism can be fabricated from any one of a number of materials that are well known to those of ordinary skill in the art such as, for example and without limitation, string materials (fabricated from natural or synthetic fibers), woven cloth, leather, and so forth. Alternative embodiments of the torso and hood mechanisms may be fabricated utilizing any number of mechanisms that are well known to those of ordinary skill in the art for tightening a garment against a body part such as, for example, and without limitation, hook-and-loop fasteners, buckles, snaps, elastic banding, zippers, and the like.

Advantageously, combinations of opening and closing mechanisms relating to the torso and the neck and head, and adjustment mechanisms relating to the torso and hood help form micro-climates for portions of the wearer's body.

Figure 7:
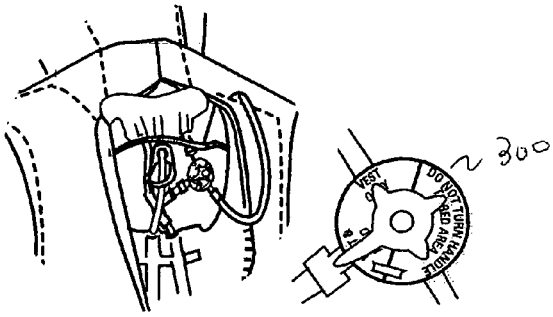
FIG. 7 shows, in pictorial form, a valve mechanism that is set to enable heat exchange fluid to flow through a torso heat exchange unit and a head heat exchange unit.
Figure 8:
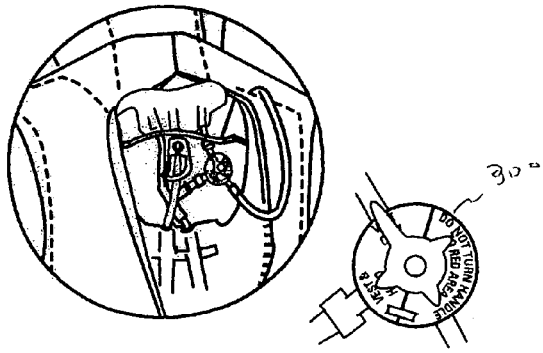
FIG. 8 shows, in pictorial form, a valve mechanism that is set to enable heat exchange fluid to flow only through one or both heat exchangers.

FIG. 7 shows, in pictorial form, an optional valve mechanism 300 (a flow director) that used in accordance with one or more embodiments of the present invention. As shown in FIG. 7, valve mechanism 300 is set to enable heat exchange fluid to flow through torso unit 110 and head unit 120. FIG. 8 shows, in pictorial form, valve mechanism 300 that is set to enable heat exchange fluid to flow only through torso unit 110. As shown in FIG. 8, valve mechanism 300 is a three-way stopcock in which one setting enables heat exchanger fluid to flow to the head, and in which the other setting enables heat exchanger fluid to flow to the torso (such a valve mechanism is well known to those of ordinary skill in the art). In accordance with one or more embodiments of the present invention, air or gas is supplied to torso unit 110, and thereafter to head unit 120 through a gas line (not shown). In accordance with one such embodiment, a bridge gas line extends between torso unit 110 and head unit 120, and the supply of gas may be cut off, if desired, to head unit 120 by use of a cut-off mechanism (for example, and without limitation, a pinch valve or clip) that is applied directly to the bridge gas line.

Those skilled in the art will recognize that the foregoing description has been presented for the sake of illustration and description only. As such, it is not intended to be exhaustive or to limit the invention to the precise form disclosed. For example, although one or more embodiments of the present invention described above related to hood and torso apparel, it should be understood that the present invention is not limited to such embodiments. In fact, further embodiments of the present invention exist which relate to apparel adapted to be worn about one or more limbs or other parts of the body, alone or in combination with apparel worn on the head and/or the torso. In accordance with such further embodiments, micro-climates can be provided for one or more various parts of the body.

What is claimed is:

1. Apparel that comprises:

a heat exchanger adapted to be worn in close proximity to a portion of a body, the heat exchanger comprising:

a first compliant component having passages to circulate a heat exchange material; and a second compliant component overlaying the first compliant component, the second compliant component having flow passages for a pressure generating material in order to apply pressure on the body;

a garment adapted to cover the heat exchanger; and a multiplicity of anchors that couple the heat exchanger and the garment at a multiplicity of anchor locations.

2. The apparel of claim 1 which further comprises a garment opening and closing mechanism.

3. The apparel of claim 2 wherein the garment opening and closing mechanism comprises one or more of hook-and-loop fasteners, draw strings, elastic banding, snaps, and zippers.

4. The apparel of claim 2 wherein the garment opening and closing mechanism comprises one or more of hook-and-loop fasteners, draw strings, elastic banding, snaps, and zippers affixed about a portion of a perimeter of the garment.

5. The apparel of claim 2 which further comprises an adjustment mechanism affixed to the garment, which adjustment mechanism and garment opening and closing mechanism are adapted to provide a micro-climate for the portion of the body.

6. The apparel of claim 5 wherein the adjustment mechanism comprises one or more of a hook-and-loop fasteners, draw string, elastic banding, a buckle, a snap, and a zipper.

7. The apparel of claim 1 wherein the heat exchanger is adapted to circulate a heat exchanger fluid.

8. The apparel of claim 1 wherein the portion of the body is a first portion and the heat exchanger is a first heat exchanger, the apparel further comprising a second heat exchanger adapted to be worn in close proximity to a second portion of the body.

9. The apparel of claim 8 wherein the garment is further adapted to cover the first and second heat exchangers, the apparel further comprising an anchor coupling the garment and the second heat exchanger.

10. The apparel of claim 8 wherein the garment is a first garment, the apparel further comprising a second garment adapted to cover the second heat exchanger and an anchor coupling the second garment and the second heat exchanger.

11. The apparel of claim 8 wherein the first and second heat exchangers are adapted to circulate heat exchange fluid serially by circulating heat exchange fluid first through the first heat exchanger and then through the second heat exchanger.

12. The apparel of claim 8 wherein the first and second heat exchangers are adapted to circulate heat exchange fluid separately.

13. The apparel of claim 8 which further comprises a flow director that adjustably directs heat exchange fluid into the first and second heat exchangers separately or serially.

14. The apparel of claim 8 wherein the first body portion is a torso.

15. The apparel of claim 8 wherein the second body portion is a head.

16. The apparel of claim 1 wherein the anchors comprise one or more of a snap, hook-and-loop fasteners, a side-release buckle, and a zipper.

* * * * *